US008201279B1

(12) United States Patent
Batstone et al.

(10) Patent No.: US 8,201,279 B1
(45) Date of Patent: Jun. 19, 2012

(54) PLATE ASSEMBLY

(75) Inventors: David Charles Batstone, West Midlands (GB); Anthony Michael Jones, Atherstone (GB)

(73) Assignee: NP Aerospace Limited, Coventry (GB)

( * ) Notice: Subject to any disclaimer, the term of this patent is extended or adjusted under 35 U.S.C. 154(b) by 1091 days.

(21) Appl. No.: 12/056,353

(22) Filed: Mar. 27, 2008

Related U.S. Application Data

(63) Continuation of application No. 10/992,938, filed on Nov. 19, 2004, now Pat. No. 7,430,768.

(30) Foreign Application Priority Data

Nov. 24, 2003 (GB) ..... 0327295.2

(51) Int. Cl.
*A41D 13/00* (2006.01)
*F41H 5/08* (2006.01)

(52) U.S. Cl. ..... 2/463; 2/2.5; 2/455; 89/36.01; 89/36.02; 89/36.05; 89/921

(58) Field of Classification Search ..... 89/36.01, 89/36.02, 36.05, 36.07, 921, 922; 2/2.5, 2/455, 463, 464, 465, 467
See application file for complete search history.

(56) References Cited

U.S. PATENT DOCUMENTS

| | | | | |
|---|---|---|---|---|
| 1,282,411 | A | 10/1918 | Golembiowski | |
| 3,061,839 | A * | 11/1962 | Foster | 2/2.5 |
| 3,331,083 | A * | 7/1967 | Holly | 2/2.5 |
| 3,398,406 | A * | 8/1968 | Waterbury | 2/2.5 |
| 3,611,438 | A | 10/1971 | Gregg et al. | |
| 3,867,239 | A | 2/1975 | Alesi et al. | |
| 3,974,313 | A * | 8/1976 | James | 428/176 |
| 4,322,858 | A * | 4/1982 | Douglas | 2/463 |
| 4,325,148 | A * | 4/1982 | Livernois | 2/465 |
| 4,356,569 | A * | 11/1982 | Sullivan | 2/2.5 |
| 4,467,476 | A | 8/1984 | Herbert | |
| 4,680,812 | A | 7/1987 | Weigl | |
| 5,020,156 | A * | 6/1991 | Neuhalfen | 2/462 |
| 5,044,011 | A | 9/1991 | Henderson | |
| 5,140,995 | A | 8/1992 | Uhl | |
| 5,333,532 | A * | 8/1994 | Smirlock et al. | 89/36.02 |
| 5,768,717 | A | 6/1998 | Le Sueur | |
| 6,026,510 | A | 2/2000 | Kocher | |
| 6,035,438 | A | 3/2000 | Neal et al. | |
| 6,170,378 | B1 | 1/2001 | Neal et al. | |
| 6,233,737 | B1 * | 5/2001 | Ditchfield et al. | 2/2.5 |
| 6,266,818 | B1 * | 7/2001 | Howland et al. | 2/2.5 |

(Continued)

FOREIGN PATENT DOCUMENTS

CA 2236399 A1 10/1999

(Continued)

*Primary Examiner* — Bret Hayes
*Assistant Examiner* — Joshua Freeman
(74) *Attorney, Agent, or Firm* — Howson & Howson LLP

(57) ABSTRACT

A protective plate assembly comprises a plurality of overlapping rigid plates (1, 2, 3) for covering a wearer's chest and abdomen, the plates being attached together such that the amount of overlap between successive plates is variable. Elements (13, 16) of compressible material are provided, distributed on an inner side of the assembly, such that when the amount of overlap between the plates (1, 2, 3) increases, the elements move closer together in the direction in which said overlap increases, and vice versa. Two adjacent plates of the assembly are attached to each other by means of a peg (12) extending from one of said plates, which peg is captive within a slot (9) on the other of said plates, the slot running substantially perpendicular to the overlapping edges of the plates.

4 Claims, 3 Drawing Sheets

U.S. PATENT DOCUMENTS

| | | | | |
|---|---|---|---|---|
| 6,305,031 | B1 | 10/2001 | White | |
| 6,370,690 | B1 | 4/2002 | Neal | |
| 6,892,392 | B2 * | 5/2005 | Crye et al. | 2/2.5 |
| 7,490,358 | B1 * | 2/2009 | Beck | 2/2.5 |
| 2001/0029621 | A1 * | 10/2001 | Howland et al. | 2/2.5 |
| 2005/0010987 | A1 * | 1/2005 | Crye et al. | 2/2.5 |
| 2005/0108800 | A1 * | 5/2005 | White | 2/2.5 |
| 2006/0048640 | A1 * | 3/2006 | Terry et al. | 89/36.02 |
| 2008/0087161 | A1 * | 4/2008 | Dean et al. | 89/36.05 |
| 2009/0113589 | A1 * | 5/2009 | Haakana | 2/2.5 |

FOREIGN PATENT DOCUMENTS

| | | | |
|---|---|---|---|
| WO | 98/27834 | A1 | 7/1998 |

* cited by examiner

PLATE ASSEMBLY

CROSS REFERENCE TO RELATED APPLICATIONS

This application is a continuation of co-pending U.S. application Ser. No. 10/992,938, filed Nov. 19, 2004, which claims the benefit under 35 USC 119 of United Kingdom Application No. 0327295.2, filed Nov. 24, 2003.

BACKGROUND OF THE INVENTION

This invention relates to a plate assembly intended to protect a wearer's chest and abdomen from ballistic impacts as well as blast and shock waves.

Plate assemblies comprising a plurality of overlapping rigid plates are used, for example, in clearing land mines and other munitions. It is often necessary to adopt a crouching or bending stance in such operations and this requires an assembly in which adjacent plates are both articulated and have a variable amount of overlap, to allow the wearer's abdomen to curl inwardly. A further requirement of such a plate assembly is that the plates themselves should not injure the wearer when subjected to a blast and/or shock wave. The requirements for articulation and decoupling from a blast wave are not readily compatible and the invention seeks to provide a plate which meets both requirements.

SUMMARY OF THE INVENTION

The present invention provides a protective plate assembly, comprising a plurality of overlapping rigid plates for covering a wearer's chest and abdomen, the plates being attached together such that the amount of overlap between successive plates is variable, wherein elements of compressible material are provided, distributed on an inner side of the assembly, such that when the amount of overlap between the plates increases, said elements move closer together in the direction in which said overlap increases, and when the amount of overlap between the plates decreases, said elements move further apart in the direction in which said overlap decreases.

The elements of compressible material may comprise strips intended to lie substantially horizontally when the assembly is worn. Alternatively, the elements may comprise elements of a lattice. The compressible material may comprise a soft, foamed fabric.

In a particular embodiment of the invention, the elements of compressible material are attached to a sheet of fabric which is in turn attached to at least those plates intended to be uppermost and lowermost when the assembly is worn. The elements may be attached to the sheet of fabric by means of one or more further sheets of fabric, which further sheet(s) may be reticulated. The further sheet(s) serve(s) to reinforce the compressible elements.

Two adjacent plates of the assembly may be attached to each other by means of a peg extending from one of said plates, which peg is captive within a slot on the other of said plates, the slot running substantially perpendicular to the overlapping edges of the plates. In this way, sliding of the peg in the slot allows said variable amount of overlap between the plates, whilst the plates are also capable of pivoting with respect to each other. The peg and/or the slot may each be formed as part of a fitting attached to the respective plate. The peg may be pivotable relative to the plate from which it extends.

The peg and slot arrangement just described is advantageous in that it allows significantly greater freedom of movement than previous assemblies. Thus, the peg and slot arrangement could also be employed in a plate assembly not having the elements of compressible material.

In addition to the peg and slot arrangement or as an alternative, adjacent plates of the assembly may be attached together by means of webs of fabric.

BRIEF DESCRIPTION OF THE DRAWINGS

Embodiments of the invention will now be described in more detail, by way of example only with reference to the accompanying drawings, in which.

DETAILED DESCRIPTION OF THE INVENTION

FIGS. 1 to 4 show a plate assembly for protecting an operative's neck, chest and abdomen against ballistic impacts and blast and shock waves. The assembly comprises a series of three plates, namely an upper plate 1, a central plate 2 and a lower plate 3. The plates are formed from a hybrid of high performance glass and ARAMID®, providing both structural strength and optimized ballistic performance. The plates 1, 2, 3 retain their integrity even when subjected to very significant levels of blast. They are shaped to conform to the wearer's body.

Figure 1:
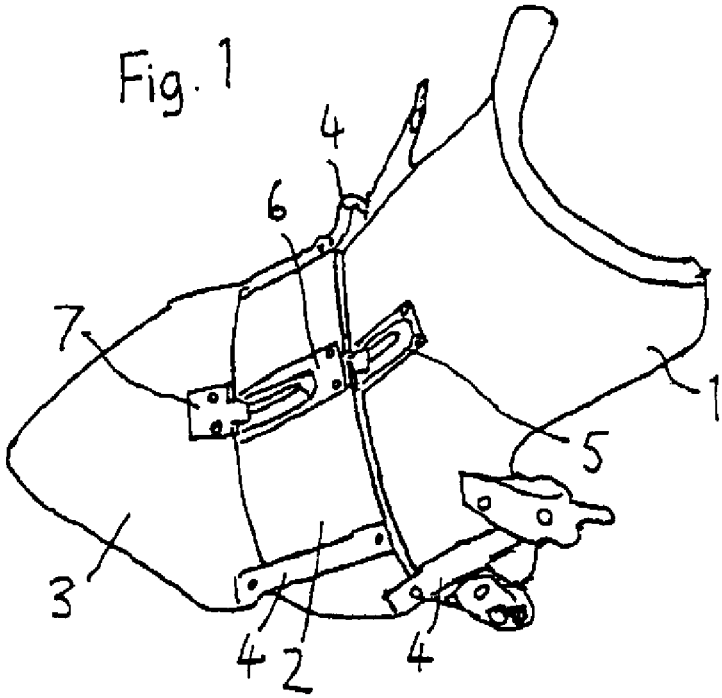
FIG. 1 is a perspective view of a plate assembly according to the invention.

Adjacent ones of the plates 1, 2, 3 are connected together at their edges by means of straps 4, shown in FIG. 1. Centrally, on the outer side of the assembly, the plates are connected together by means of a peg and slot arrangement, shown in FIG. 2. A fitment 5, 6, 7 is attached to each of the plates 1, 2, 3 respectively. The fitments 5 and 6 are each attached adjacent the lower edge of the upper and central plates 1, 2 respectively. Each of the fitments 5, 6 comprises a substantially planar element 8 including a raised section defining a slot 9 running perpendicular to the edge of the plate.

Figure 2:
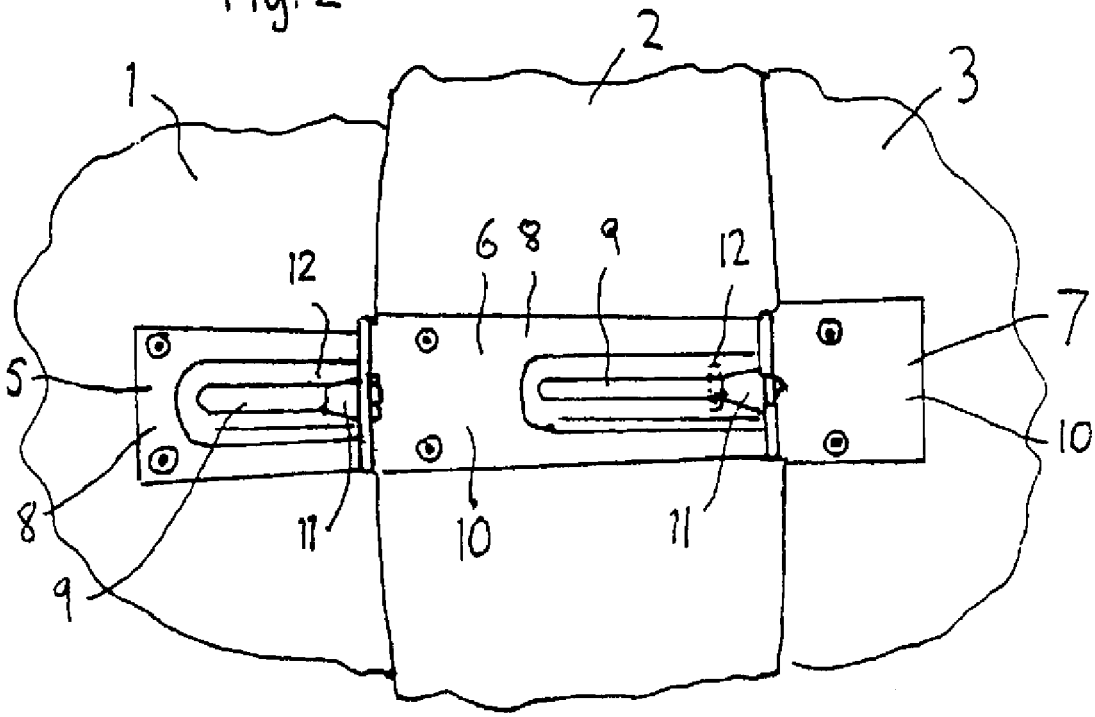
FIG. 2 is a fragmentary view showing a peg and slot arrangement of the assembly of FIG. 1 in more detail.

The fitments 6 and 7 attached to the central and lower plates 2, 3 respectively each comprise a hinge having a first hinge leaf 10 attached to the plate 2 or 3 adjacent an upper edge thereof, for example by riveting, and a second hinge leaf 11 extending from said upper edge. A peg 12, shown in phantom in FIG. 2, is attached to the end of the second hinge leaf 11. It will be seen that the first hinge leaf 10 and the substantially planar element 8 of the central fitment 6 are one and the same.

Each of the pegs 12 comprises a transversely extending portion which is captive within the slot 9 of the fitment 5, 6 immediately above the respective peg. Thus the pegs 12 can slide within the slots 9 to vary the amount of overlap between adjacent plates. However, the lower end of each slot 9 is spaced from the lower edge of the respective plate 5, 6 such that there is always sufficient overlap between adjacent plates to prevent ingress of a blast wave.

In addition to the sliding motion provided by sliding of the pegs 12 in the slots 9, pivoting of the hinges of fitments 6 and 7 allows the angle between adjacent plates to be varied.

Figure 3:
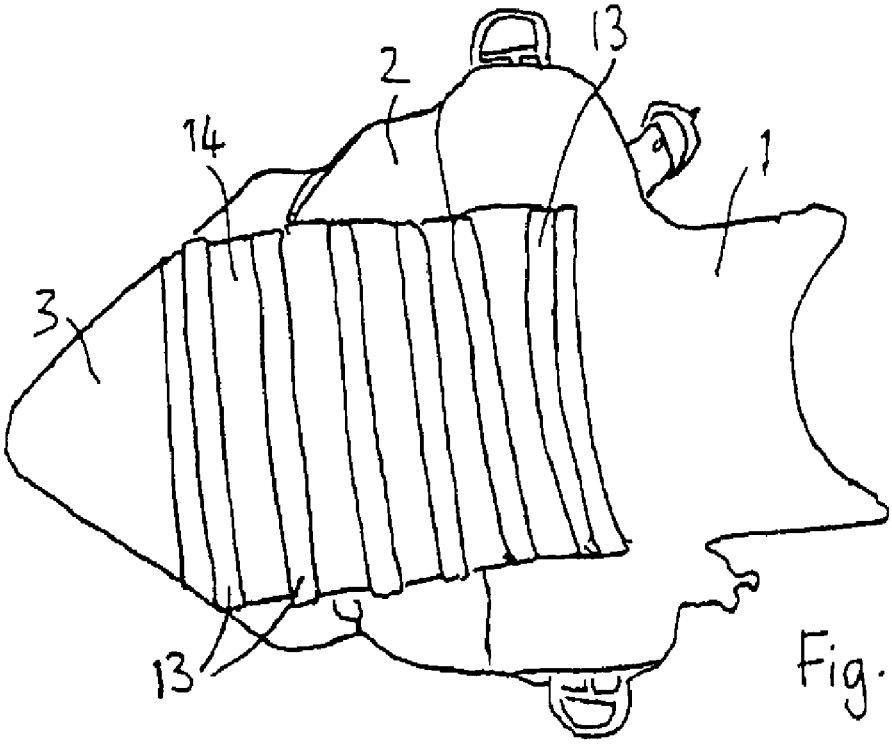
FIG. 3 shows the inner side of the assembly of FIG. 1.
Figure 4:
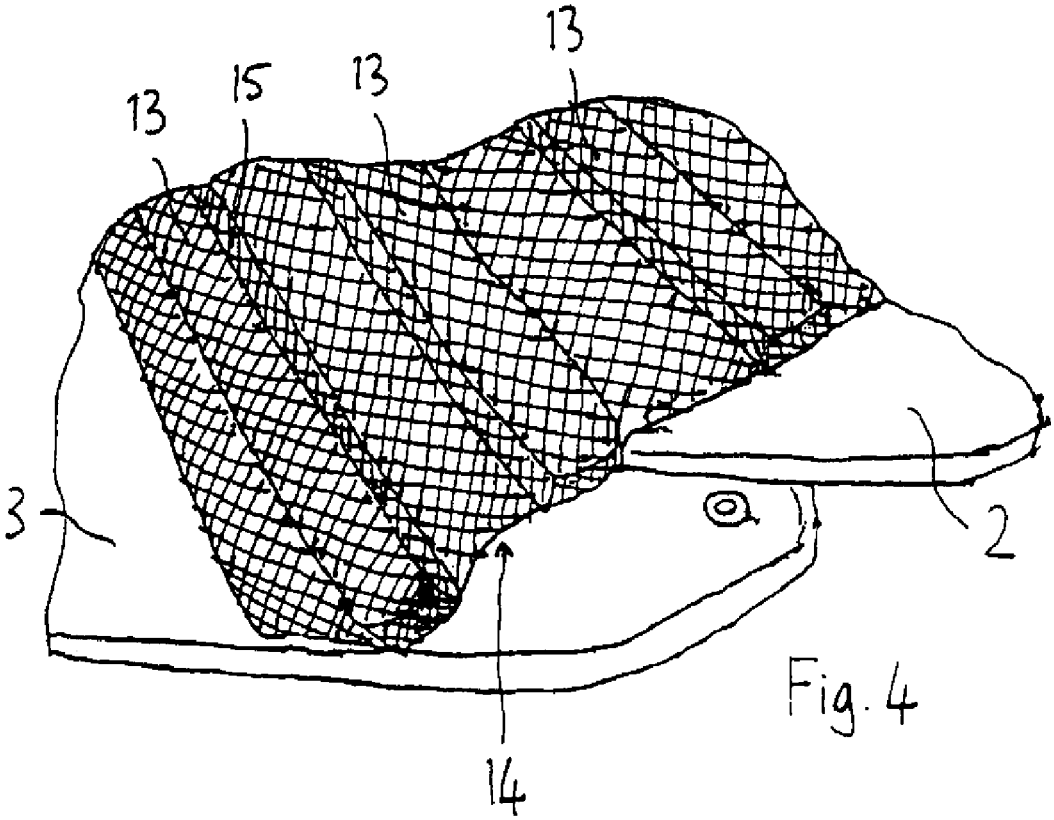
FIG. 4 is a fragmentary view showing details of compressible elements of the assembly of FIGS. 1 to 3.

FIGS. 3 and 4 show compressible elements in the form of horizontally-extending foam bars 13 attached to a sheet of strong fabric 14 which is in turn attached to the inner side of the plate assembly. A sheet of fabric netting 15 is attached over the foam bars 13 to reinforce them and is attached to the fabric sheet 14 in the spaces between the foam bars.

In use of the plate assembly, the foam bars 13 are of sufficient performance to protect the wearer's lungs and abdomen by absorbing the energy imparted to the assembly by a blast or shock wave.

It will be appreciated that when the plates 1, 2, 3 slide with respect to each other to increase the amount of overlap between adjacent plates, the foam bars 13 move closer together, whilst when the overlap between adjacent plates decreases, the bars 13 move further apart. Thus the foam bars do not restrict the movement of the plates with respect to each other and consequently they do not restrict the movements of the wearer.

Figure 5:
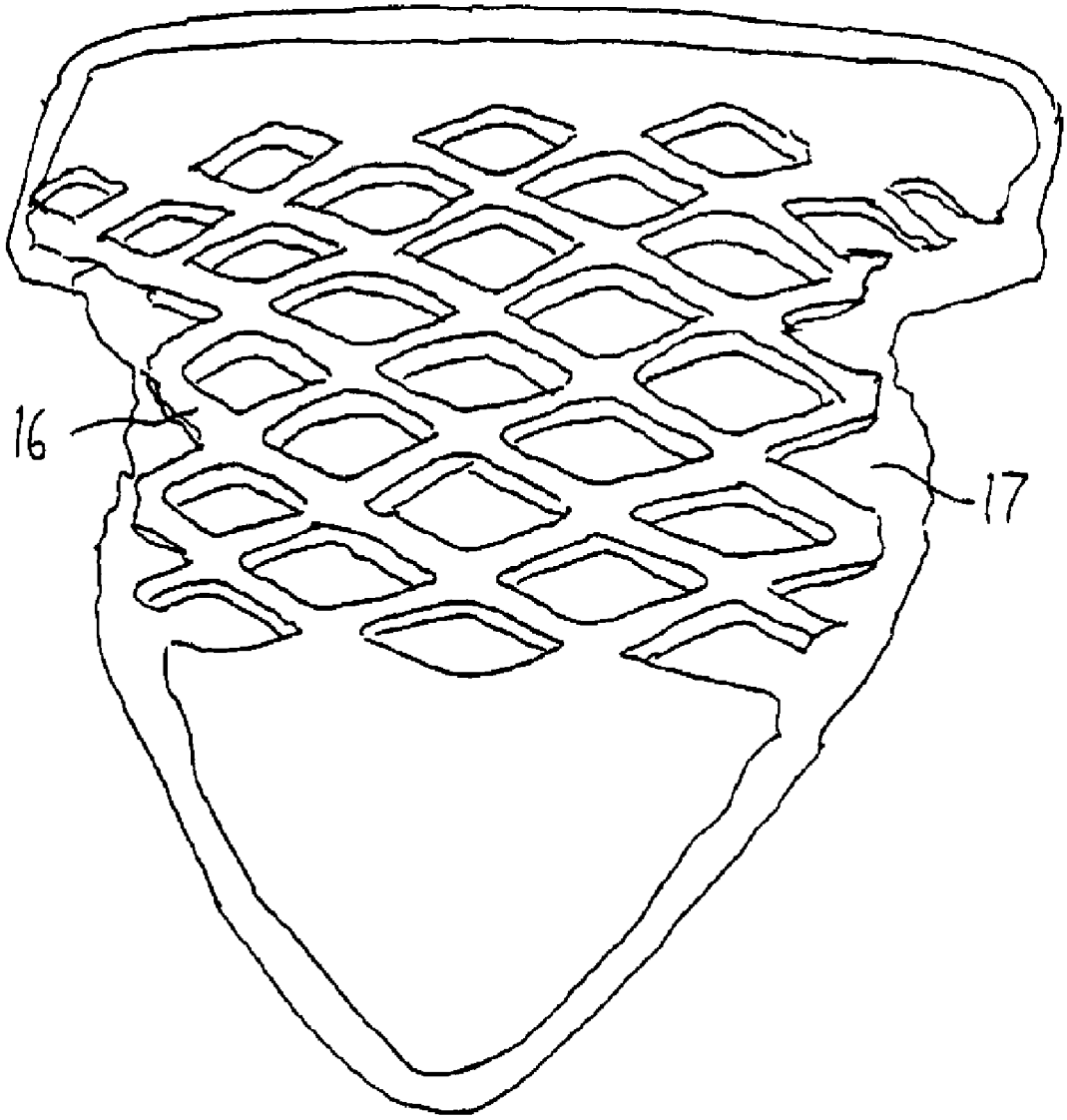
FIG. 5 shows a lattice of compressible elements according to an alternative embodiment of the invention.

FIG. 5 shows an alternative form of compressible elements in the form of a foam lattice 16 reinforced by a sheet of fabric 17. It will be appreciated that the elements of the lattice are capable of movement in a similar manner to the foam bars 13.

The invention claimed is:

1. A protective plate assembly, comprising a plurality of overlapping rigid plates for covering a wearer's chest and abdomen, the plates being attached together such that the amount of overlap between successive plates is variable, wherein elements of compressible material are provided, distributed on an inner side of the assembly, such that when the amount of overlap between the plates increases, said elements move closer together in the direction in which said overlap increases, and when the amount of overlap between the plates decreases, said elements move further apart in the direction in which said overlap decreases, and wherein the elements of compressible material are attached to a sheet of fabric which is in turn attached to at least those plates intended to be uppermost and lowermost when the assembly is worn.

2. An assembly according to claim 1, wherein the elements of compressible material comprise strips intended to lie substantially horizontally when the assembly is worn.

3. An assembly according to claim 1, wherein the elements of compressible material comprise elements of a lattice.

4. An assembly according to claim 1, wherein the compressible material comprises a soft, foamed fabric.

* * * * *